US009145641B2

(12) United States Patent
Gingras

(10) Patent No.: US 9,145,641 B2
(45) Date of Patent: Sep. 29, 2015

(54) APPARATUS FOR DISPERSER PLATE AND METHOD TO REFINE PAPER

(71) Applicant: Andritz Inc., Glens Falls, NY (US)

(72) Inventor: Luc Gingras, Harrogate (GB)

(73) Assignee: Andritz Inc., Glens Falls, NY (US)

( * ) Notice: Subject to any disclaimer, the term of this patent is extended or adjusted under 35 U.S.C. 154(b) by 0 days.

(21) Appl. No.: 14/082,424

(22) Filed: Nov. 18, 2013

(65) Prior Publication Data

US 2014/0196858 A1 Jul. 17, 2014

Related U.S. Application Data

(60) Provisional application No. 61/736,876, filed on Dec. 13, 2012.

(51) Int. Cl.

| | |
|---|---|
| ***D21D 1/30*** | (2006.01) |
| ***D21B 1/08*** | (2006.01) |
| ***B02C 7/12*** | (2006.01) |
| ***D21D 1/00*** | (2006.01) |
| ***D21D 1/22*** | (2006.01) |
| *D21D 1/26* | (2006.01) |

(52) U.S. Cl.

CPC ... *D21B 1/08* (2013.01); *B02C 7/12* (2013.01); *D21D 1/008* (2013.01); *D21D 1/22* (2013.01); *D21D 1/30* (2013.01); *D21D 1/306* (2013.01); *D21D 1/26* (2013.01)

(58) Field of Classification Search

CPC ..... D21D 1/22; D21D 1/26; D21D 1/30; B02C 7/12

See application file for complete search history.

(56) References Cited

U.S. PATENT DOCUMENTS

| | | | | | |
|---|---|---|---|---|---|
| 3,144,994 | A | * | 8/1964 | Danforth | 241/261.1 |
| 4,166,584 | A | | 9/1979 | Asplund | |
| 5,695,136 | A | * | 12/1997 | Rohden et al. | 241/261.3 |
| 5,893,525 | A | | 4/1999 | Gingras | |
| 6,032,888 | A | * | 3/2000 | Deuchars | 241/261.3 |

FOREIGN PATENT DOCUMENTS

| | | |
|---|---|---|
| DE | 1 213 206 | 3/1966 |
| DE | 1 243 507 | 6/1967 |
| GB | 848569 | 9/1960 |

OTHER PUBLICATIONS

Smook, Handbook for Pulp and Paper Technologists, 1992, Angus Wilde Publications, 2nd edition, chapter 13.*

European search report cited in European patent application No. 13 19 6198, completed Jan. 29, 2014.

* cited by examiner

*Primary Examiner* — Anthony Calandra

(74) *Attorney, Agent, or Firm* — Kerri Hochgesang; Robert Joseph Hornung

(57) ABSTRACT

An assembly of opposing discs or cones for a disperser where each disc or cone has mounted to it a plate or an array of plate segments with a front surface on each plate or array of plate segments and each surface has a series of bars, grooves and dams. The bars are in rows, with the rows separated by annular dams at substantially fixed radial locations, and the grooves are adjacent the bars in the rows so that the grooves form a serpentine passage extending radially between the opposing plates or array of plate segments on the opposing discs or cones. The opposing plate or array of plate segments are arranged such that the annular dams on one plate or array of plate segments face roughly the middle of the row of bars on the opposing plate or array of plate segments.

20 Claims, 6 Drawing Sheets

APPARATUS FOR DISPERSER PLATE AND METHOD TO REFINE PAPER

CROSS-REFERENCE TO PRIOR APPLICATION

This application claims the benefit of priority to U.S. App. No. 61/736,876 filed on Dec. 13, 2012, the entire contents of which are incorporated herein by reference.

TECHNICAL FIELD

This disclosure relates to disperser machines for converting paper to pulp and particularly to plates for disperser machines.

BACKGROUND OF THE INVENTION

It is desirable to recycle paper and packaging materials to reduce waste and reuse valuable natural resources. Recovered paper and packaging materials are subjected to several processes to remove ink, toner, and other contaminants such as glue and plastics that are commonly found on used paper and packing materials. The glue, plastics, and other similar contaminants are generally referred to as "stickies" by those skilled in the art. It is desirable for the ink, toner, and stickies to be removed before the recovered paper and packing materials are introduced into, for example, a paper-making machine.

If stickies are not properly removed, the stickies can adhere to the paper-making machine and create holes or weak spots in the reconstituted paper formed by the recovered paper and packaging material. Further, residual ink and toner particles can appear as blemishes in the reconstituted paper. Blemishes generally reduce the value of reconstituted paper.

A disperser, which is also known as a disperger, is a machine that processes recovered paper and packaging material for use in making paper or other products. Dispersers help remove ink, toner, and stickies from fibers, and reduce the particulate size of stickies in the recovered paper and material.

A conventional disperser typically includes a rotating rotor disc opposing a stationary stator disc. Each disc typically includes an assembly of pie-shaped plate segments arranged in a circular array to form a plate and mounted on a disc substrate, thereby creating the dispersing disc. The pie-shaped plate segments may be similar in shape to a truncated wedge formed by a minor sector of a circle. The front surface of each plate, which faces the front surface of the opposing plate, typically includes pyramids or teeth arranged in rows extending generally circumferentially across the plate. The circumferential rows of teeth or pyramids on one plate intermesh, e.g., are interlaced, interleave, or are staggardly interposed, between the rows of the teeth or pyramids on the opposing plates in a complementary manner. The rows are arranged at radii which allow the rows of pyramids or teeth on the plates mounted on the rotor and stator disc substrate to intersect a plane between the discs. This plane can be parallel to the front surface of the discs.

The intersection of the plane by the rows of teeth and/or pyramids enhance the impacts by the teeth and pyramids on the fibers of the recovered paper and packing material moving from the center of the stator disc to the periphery of the discs. The design of the disperser plate pyramids or teeth is referred to as "intermeshing tooth patterns". These teeth and pyramids are generally part of the mold for the entire disc, disc segments, cone, or cone segments. Therefore, these teeth and pyramids are generally formed when the original disc, disc segment, cone, or cone segment is cast. These teeth and pyramids also extend outward from the front surface of each plate. The gap, i.e. the clearance between the pyramids or teeth of the rotor and stator discs is usually in a range of 1 to 6 millimeters (mm). The gap generally has a zigzag shape formed by the intermeshing rows of the teeth of the opposing plates. A conventional disperser plate is described in U.S. Pat. No. 7,172,148.

The gap of a typical intermeshing tooth disperser plate design allows a relatively thick fiber pad to form between the opposing faces of the rotor and stator plates. The teeth and pyramids act on the fibers in the pad. In a disperser, the fibers of the recovered paper or packing material are not cut or refined. The fibers are severely and alternately flexed by the action of the intermeshing patterns of teeth or pyramids on opposing front surfaces of a disperser plate. This action breaks the stickies into smaller particles. The smaller particles of the stickies may collect fine fiber particles that are further passivated as smaller particles.

An alternative conventional disperser uses conical surfaces rather than the planar surfaces of the discs. The rotating rotor is a cone having an outer surface with teeth. A stator is stationary and has a conical shape with an inside surface with rows of teeth or pyramids. The inside surface faces the outer surface of the rotor such that the rows of teeth or pyramids on the stator are intermeshed, that is staggardly interposed with the rows of teeth or pyramids on the rotor in a complementary manner. Teeth and pyramids are part of the mold for the entire cone or cone segment. Therefore, these teeth and pyramids are generally formed when the original cone or cone segment is cast.

In contrast to recovering paper and packaging material, fresh pulp for paper and paper based packaging materials is typically formed or developed using a mechanical refiner. Mechanical refiners may comprise refiner plate segments arranged in a circular array to form a plate; plates are generally mounted on disc substrates, on opposing discs. The discs may be flat (planar) or conical. The opposing plates mounted on the opposing discs may both rotate or one may be stationary while the other rotates.

Mechanical refiners, in contrast to dispersers, refine lignocellulosic material, such as wood chips, wood pulp, or other cellulosic material, by separating fibers in the lignocellulosic material. Refiner plates typically have a front face with a pattern of bars and grooves arranged in one or more refining fields. The bars have precision machined top surfaces. The feed material, lignocellulosic material such as wood chips or other cellulosic material, moves through a gap between the tops of the bars on opposing plates on the opposing discs. The gap is typically less than 1 mm. The refining action occurs as feed material passes generally radially outwardly through the gap between the opposing relatively rotating discs. The feed material is refined as it moves radially outward through the small gap between the discs and is impacted as opposing bars cross each other. The feed material also moves radially outward through the grooves between the bars extending radially. As the material moves from the inner portion of the discs to the outer region of the discs, the crossing of the bars allows for developing and cutting of the feed material.

The bar and groove patterns of refiner plates and resulting impacts due to the crossing of bars is suited for refining of lignocellulosic material. A benefit of discs in a conventional mechanical refiner is the high compression action discs can impart to the material within the refiner due to the small gap (typically less than 1 mm) and crossing of the bars, resulting in development of enhanced fiber bonding properties.

However, bar and groove patterns of refiner plates mounted on the discs of a conventional mechanical refiner are not well-suited to processing recovered paper and packaging material, in part, because the presence of ink and stickies. To remove stickies, dispersers require a thick fiber pad to form between the plates; the required thick fiber pad is not achieved with conventional bar and groove patterns. Conventional bar and groove patterns usually create a relatively evenly distributed thin fiber pad in the gap. A thick fiber pad is needed in view of the dispersion action of the intermeshing pyramids or grooves. The bars of a conventional mechanical refiner plate are not well-suited to creating the thick fiber pad needed for optimal dispersion action. Furthermore, the frequency at which bars cross in a typical or conventional mechanical refiner would be too high to adequately break up the stickies.

BRIEF DESCRIPTION OF THE INVENTION

There is an identified need in many applications to combine dispersion, i.e. the breaking down of inks, toners, and stickies, and mechanical refining, i.e. fiber development in the same machine. Neither disperser plates nor refiner plates are suited to perform both tasks effectively. A plate has been developed with the intention to provide the best combination of dispersion and refining to be achieved in a single operation, a single machine.

Plates for a disperser has been conceived for removing contaminants, e.g., stickies, from recovered paper and packaging fibrous materials while also providing some refining of the fibrous material. These plates are made up of a series of plate segments arranged adjacent to one another to form a plate; the plate is mounted on the disc. The discs may be planar (flat) or conical. The front surfaces of the plates include rows of bars having flat upper surfaces, rather than teeth with pyramidal shapes of conventional disperser plates. The bars' flat upper surfaces may be milled, ground or otherwise machined, thus providing a precise profile which allows operation at very precise and controlled relative position between working surfaces of rotor and stator bars. The upper surfaces of the bars need not intermesh as do conventional plates for dispersers. A narrow gap, e.g., on the order of 1 millimeter (mm), may exist between the upper surfaces of the opposing bars wherein the gap is parallel to the upper surfaces of the plates and to the discs or cones.

A disperser assembly has been conceived comprising: opposing arrays of fusion plate segments, wherein each fusion plate segment in the opposing arrays of fusion plate segments comprises a front surface having rows of alternating fusion bars and grooves, wherein each fusion bar has a planar upper surface and each row of alternating fusion bars and grooves is separated by annular dams located at substantially fixed radial locations on the front surface of each opposing fusion plate segment, wherein a number of alternating fusion bars and grooves increases as the rows of alternating fusion bars and grooves extends radially outward along the front surface, wherein the opposing arrays of fusion plate segments are arranged such that the annular dams on one fusion plate segment align with a row of fusion bars and grooves on an opposing fusion plate segment; and wherein the grooves form a serpentine passage extending radially between the opposing arrays of fusion plate segments.

The bars with flat upper surfaces, referred to as "fusion bars," represent a fusion of technology from conventional refiner plates and conventional disperser plates. The fusion bars on one fusion plate are arranged in rows that are offset with respect to the rows of fusion bars on the opposing fusion plate. These fusion plates may be mounted on a disc or cone of the disperser machine. The fusion bars in each row are positioned at substantially uniform radial distances on the fusion plate. A transition region of annular dams may be positioned between the rows of fusion bars. The dams may be subsurface or surface dams and extend from one side of the fusion plate segment to the other side of the fusion plate segment. When the fusion plate segments are mounted to the disc, the dams form an annular band between the rows of fusion bars. The row of fusion bars may be aligned to face an annular dam—between successive rows of fusion bars on an opposite disc or cone. The annular dams may also be used to deflect the flow of recovered paper and therefore may be known as "flow deflectors." The fusion bars in each row may be substantially parallel to each other and have grooves between the bars, the grooves being parallel to the bars. These grooves generally have a width of between three and ten mm.

The machined upper surfaces of the fusion bars provide precision regarding the height of the bars and ensure that the upper surfaces are in the same plane. Due to the uniformity of the upper surfaces, the gap between opposing fusion plates may be narrow and uniform. The upper surfaces of the teeth or pyramids of conventional disperser plates are usually formed in the molding of the entire plate. Molding does not provide the same uniformity of working surfaces of teeth or pyramids that can be achieved with machining of those surfaces in the fusion bars for the fusion plate. The potential to use small gaps between fusion plates with fusion bars may permit desirable refining action on the recovered paper and packaging materials. Furthermore, the substantially annular dams found at substantially constant radial locations at the transitions between each row of fusion bars may allow for building up of a thick fiber pad in those locations. This thick fiber pad is formed as the annular dams force all material to enter the gap at the radial location of the annular dam. The annular dams at the transitions between rows of fusion bars create a serpentine path of the fiber material passing through the gap. The annular dams separate the rows of fusion bars. Having the annular dams at substantially fixed radial locations on the fusion plates causes a large fiber accumulation at these locations, which creates the thick fiber pad needed for good dispersion efficiency to occur. The thick fiber pad created by the annular dams on one plate is substantially opposite the middle of the opposing plate's fusion bar row, thus a serpentine path for the fiber material to move through the disperser is formed.

By providing a plate with bars having a flat upper surface and annular dams in a bar and groove plate, creating a serpentine path to give both large localized fiber accumulations (on radial locations in from of the dams) and precisely ground surfaces on the bars, the fusion plates can be run with much tighter gaps and with large localized fiber accumulations, thus allowing suitable dispersion to take place through the thick fiber pad, and suitable refining to take place in a small controlled gap allowing for high compression of the fiber pad.

The fusion bars of the fusion plates for the disperser disc or cone provide the desired separation of stickies and contaminants from the feed material. The offsetting rows of fusion bars form a serpentine flow passage for a feed material, so that a thick pad of fibrous material of recycled paper and packaging material can form in those locations where such material is forced from one disc through the gap and towards the opposing disc. The flexing and bending of the fibrous material as it moves through the serpentine flow passage radially, which includes moving over the annular dams between rows of fusion bars and between the fusion bars, causes the stickies in the feed material to dislodge from the feed material and disperse into the fibrous material. Further, the flat surfaces with cutting edges on the fusion bars provide for fiber development, such as strength increase, and fiber cutting.

A fusion plate with fusion bars may be an assembly of pie-shaped fusion plate segments and may be mounted sequentially side-by-side on a disc or cone substrate to form a circular disc or a conical surface. In some embodiments, the fusion plates may be annular, circular or semi-circular. The front surface of the fusion plate or fusion plate segment mounted on the disc or cone may include a radially inward feed zone adjacent to the material entrance nearest the inner periphery of the plate or plate segment. This front surface may include a processing zone between the feed zone and an outer periphery of the fusion plate segment or fusion plate. The processing zone has an annular pattern or annular field of fusion bars and grooves. The processing zone may extend from the feed zone a radial distance of at least fifty percent (50%) or at least seventy percent (70%) of the distance between the end of the feed zone and the outer periphery of the fusion plate segment or fusion plate. Radially outward of the pattern or field of fusion bars may be another pattern or field of fusion bars or conventional teeth or pyramids conventional for disperser plates. The additional field(s) or pattern(s) of bars, teeth or pyramids may be conventional refiner bar and groove patterns that do not intermesh, intermeshing fusion bars, or conventional disperser teeth or pyramids. For example, if significantly increased dispersion is desired in addition to the refining and dispersion caused by the processing zone, at least one pattern or field of conventional disperser teeth or pyramids may be added to the remaining 50% of the radial distance of the front surface of the fusion plates or plate segments not occupied by the feed zone and processing zone. If a relatively small amount of additional refining is desired, for example, at least one additional pattern of bars and grooves may be added the remaining 30% of the radial distance of the front surface of the fusion plates or plate segments not occupied by the feed zone and processing zone.

The grooves on the fusion plate segments or fusion plate of a stator disc or cone between the fusion bars may be relatively wide such as 3 mm to 10 mm or more, or 5 mm to 7 mm. For example, if it increasing a portion of energy being applied to refining is desired, narrower bars in a range of 3 mm to 5 mm may be used. If for example, increasing the proportion of energy being applied to dispersion is desired, wider bars in a range of 6 mm to 10 mm may be used. The width of the grooves between the fusion bars of the fusion plate in the rotor disc or cone may be similar to the groove width in opposing patterns or fields of the fusion plate on the stator disc. The grooves of the fusion plate mounted on the stator disc or cone may be shallower than opposite grooves on the fusion plate mounted on the rotor disc or cone. The wide and shallow grooves on the fusion plate mounted on the stator disc or cone are less likely to fill and plug with fibers. There is a desire to avoid having fibers becoming lodged in grooves of the fusion plate on the stator disc or cone as the lodged fibers tend to darken and, when dislodged, thereby affecting the quality of the pulp discharged from the disperser.

As the fusion plates mounted on the rotor disc or cone has a self-cleaning effect, in some embodiments it may be desirable to have narrower grooves between row of bars in the fusion plate of the rotor disc or cone as compared to the stator disc or cone.

The width of the individual fusion bars on the fusion plate segments on both the stator and rotor discs or cones may be similar to, or substantially the same as the width of the grooves between the fusion bars or slightly narrower than the grooves between the fusion bars. It may be desirable for each of the fusion bars to have profiles from the bottom of the groove to the top flat surface of the fusion bars that enhance the flow of fiber towards the gap between the discs. For example, a ramp on each fusion bar in the stator or rotor fusion plate segment may be useful to reduce choking the flow of feed material.

The number of bars should typically increase going from the innermost row of fusion bars to the outermost rows of fusion bars on the fusion plate. This allows for increased amount of energy input towards the periphery of the fusion plates. The amount of bars should ideally increase at every transition annular dam, but it is possible to increase only once, twice, or only at certain transition annular dams. Increasing the number of bars is usually achieved by reducing the width of the grooves separating the fusion bars, the width of the fusion bars, or a combination of both.

Other embodiments of the disperser fusion plates or fusion plate segments may have one or more narrow grooves, mini-grooves, in the upper surface, top surface, of at least one of the fusion bars (mini-grooves for a conventional refiner plate are as shown in U.S. Pat. No. 5,893,525) to provide more edges useful to achieve the desired combination of dispersing and refining action.

The shape of the grooves within rows of fusion bars may change from row to row. Potentially useful groove shapes include grooves having: a smooth rounded side with a flat bottom (a bowl shape); a continuously sloping sinusoidal; box-like with straight-lined sides, which could be angled, or angled and vertical or horizontal, with a flat straight bottom. These patterns allow for the proper flow of material from the inlet to the periphery of the fusion plates, creating the right conditions for radially localized large accumulations of pulps to create the ideal conditions for dispersion and with potential to run with a gap sufficiently small to allow for the desired refining action.

An assembly of opposing discs or cones for a disperser has been conceived, wherein each disc or cone has mounted to it a plate or an array of plate segments comprising a front surface on one plate or array of plate segments opposing the front surface on other plate or array of plate segments, the front surface includes rows of bars and grooves with each bar having a planar upper surface and annular dams between the rows of bars, wherein the grooves form a serpentine passage extending radially between the opposing plates or array of plate segments on the opposing discs or cones wherein the dams, separating the rows of bars, being located at substantially fixed radial locations; and wherein the opposing plate or array of plate segments are arranged such that the annular dams on one plate or array of plate segments face roughly the middle of the row of bars on the opposing plate or array of plate segments.

In at least some embodiments the front surfaces of the opposing plates or plate segments are divided into at least one of a feed zone, processing zone, flat surface between an inner periphery and an outer periphery of the plate of plate segment.

At least some embodiments, the rows of fusion bars and grooves that are disposed radially outward on the plate or plate segment may have grooves that are narrower than the grooves in the rows of fusion bars and grooves that are disposed radially inward on the plate or plate segment. The plate or plate segments may be mounted on a disc or cone.

It may also be desirable in some embodiments to have a radius of an end of a row of fusion bars on the front face of one of the plates or plate segments mounted on the disc or cone to align with the radius of a center of a row of fusion bars on the opposing plate or plate segment mounted on the opposing disc or cone.

For some embodiments, the annular dams between rows of bars and grooves on one plate segment may be aligned with a nadir of the grooves of the row fusion bars and grooves on the opposing plates or plate segments mounted on opposing discs or cones.

BRIEF DESCRIPTION OF THE DRAWINGS

The foregoing will be apparent from the following more particular description of example embodiments of the disclosure, as illustrated in the accompanying drawings in which like reference characters refer to the same parts throughout the different views. The drawings are not necessarily to scale, with emphasis instead being placed upon illustrating embodiments of the disclosed device.

DETAILED DESCRIPTION OF THE INVENTION

The need to combine dispersing and refining functions to recover and reuse paper and other packaging materials presents unique requirements for the discs and cones for dispersers. New plates or plate segments for mounting on stator and rotor discs and cones have been conceived and developed to overcome the disadvantages of using either a conventional refining plate mounted on a refining disc or cone, or a conventional dispersing plate mounted on a conventional dispersing disc or cone to obtain the needed separation of ink and other contaminants and provide desired refining of the recycled material.

Figure 1:
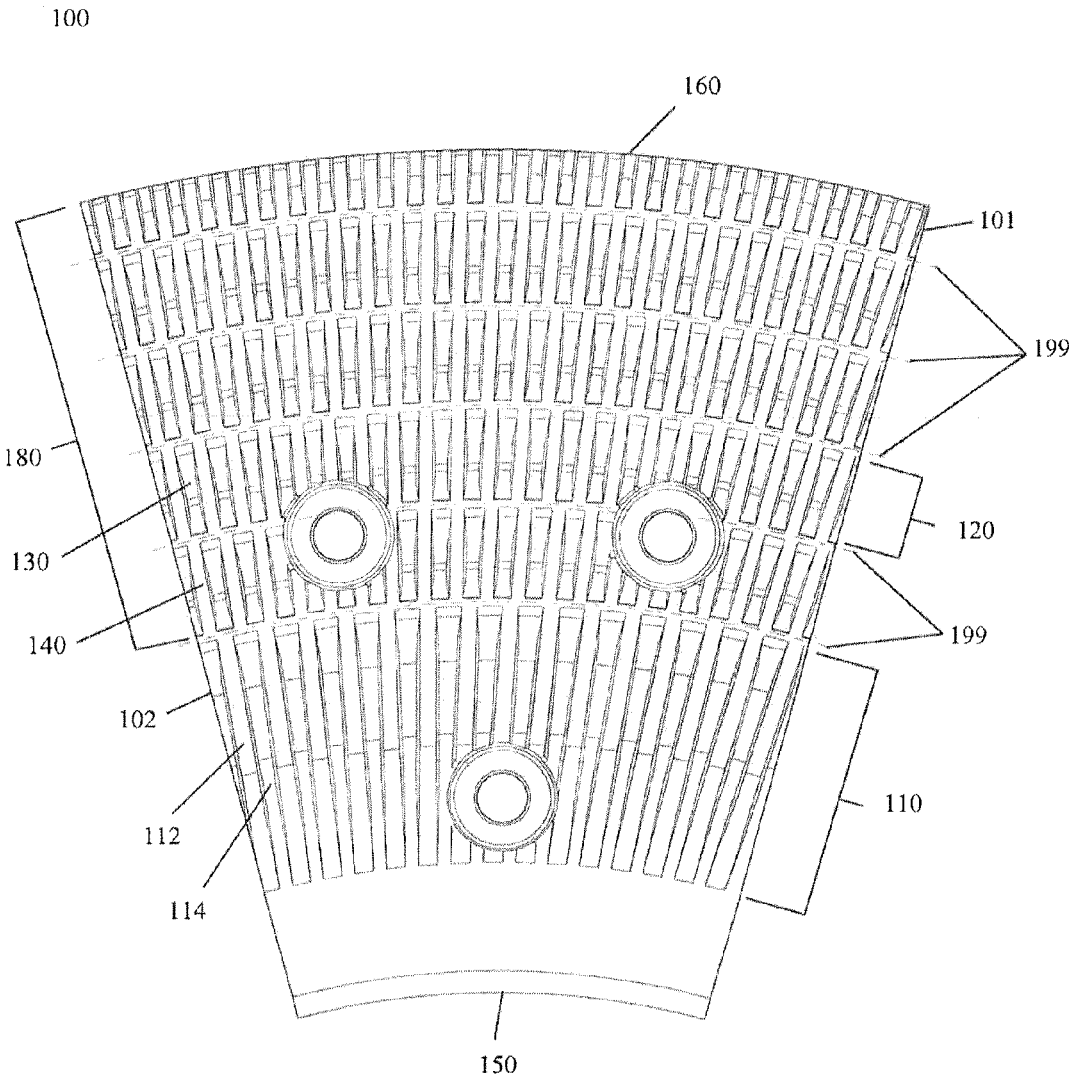
FIG. 1 is a face view of a fusion plate segment for a stator disc.

FIG. 1 shows a segment of a stator fusion plate segment 100 (a fusion plate segment for mounting on a stator disc) useful for performing both dispersing and refining actions. The stator fusion plate segment 100 is has a feeder zone 110, beginning at the inner portion or inner periphery 150 of the stator fusion plate segment 100, and a processing zone 180 extending radially outward of the feeder zone 110. The feeder zone 110 is comprised of long bars 112 and long grooves 114, which are between and formed by the bars, capable of accepting feed material and pushing it to the processing zone 180.

The processing zone 180 includes a pattern of rows 120 of fusion bars 140 (resembling the individual teeth of a conventional disperser plate).

Successive annular rows 120 of fusion bars 140 are separated by annular dams 199. The fusion bars 140 are oriented substantially radially, but may be offset from a pure radial line by several degrees, e.g., 2, 5 or 10 degrees or more. The fusion bars 140 in each row 120 are substantially parallel to each other and are separated by grooves 130 which may have widths similar to the width of each fusion bar 140, or the widths can be wider or narrower than that of the fusion bars 140.

FIG. 1 shows the processing zone 180 extending in a series of rows 120 from the radially outer edge of the feeder zone 110 to the outer portion or outer periphery 160 of the stator fusion plate segment 100. In another embodiment, the processing zone 180 (or at least the patterns of fusion bars 140) for both rotor and stator plate segments may not extend to the outer periphery 160 of the stator fusion plate segment 100 and may extend only half-way between the outer periphery 160 and the feeder zone 110. The rows of bars radially outward of the fusion bars 140 may conform to bars of conventional refiner plates or teeth or pyramids of conventional disperser plates. There may also be a flat zone (not shown in FIG. 1) between the outer edge of the processing zone 180 and the outer periphery 160 of the stator fusion plate segment 100. The rows 120 of fusion bars 140 are separated by annular dams 199. Annular dams 199, between the rows 120 of fusion bars 140, extending from one side 101 of the stator fusion plate segment 100 to the opposite side 102 of the stator fusion plate segment 100 form a circle when the individual stator fusion plate segments 100 are mounted on the disc (both stator and rotor discs) to form the stator fusion plate. These annular dams 199 allow a distinct separation between the rows 120 of fusion bars 140 and serve to force the material to travel out of the grooves 130 and into the gap formed between the rotor and stator discs at a substantially fixed radial location. By forcing the material out of the grooves 130 and into the gap causes the desired thick fiber pad to accumulate in the gap between the discs. It is the ability to form the thick fiber pad using flat top bars and narrow gap between discs which differentiates the embodiments of this disclosure from conventional disperser or refiner plates. In some embodiments, the annular dams may be somewhat below the surface of the plates in some or all of their radial locations.

Figure 2:
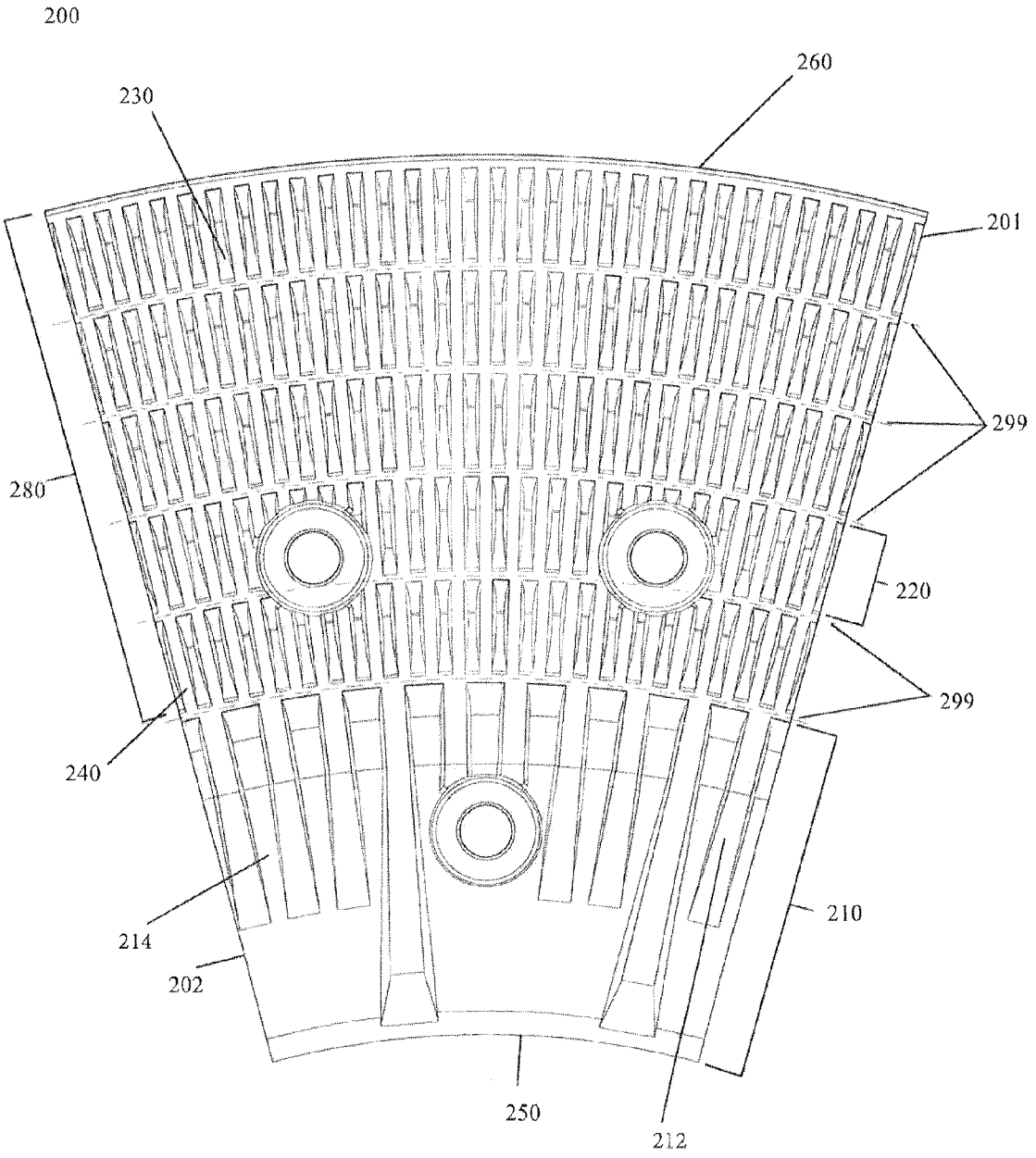
FIG. 2 is a face view of a fusion plate segment for a rotor disc.

FIG. 2 shows a segment of a rotor fusion plate segment 200 where both dispersing and refining actions can be accomplished. The portions of the rotor fusion plate segment 200 similar to the stator fusion plate segment 100 shown in FIG. 1 are labeled with similar reference numbers.

The rotor fusion plate segment 200 is shown with feeder zone 210, beginning at the inner portion or inner periphery 250 of the rotor fusion plate segment 200, and a processing zone 280. The feeder zone 210 is comprised of long bars 212 and long grooves 214, or any other suitable pattern capable, of accepting feed material and pushing it to the processing zone 280.

The processing zone 280 is made of rows 220 of individual fusion bars 240, fusion bars 240 within the rows 220 are separated by grooves 230. The fusion bars 240 are oriented substantially radially and may be offset as discussed above for the offset of fusion bars 140 on the stator fusion plate segment 100 of FIG. 1. The fusion bars 240 are also generally parallel. As with the stator fusion plate segment 100 of FIG. 1, the rows 220 of fusion bars 240 of the rotor plate segment 200 are separated by annular dams 299. Annular dams 299, between the rows 220 of fusion bars 240, extending from one side 201 of the rotor fusion plate segment 200 to the opposite side 202 of the rotor fusion plate segment 200 form a circle when the individual rotor fusion plate segments 200 are mounted on the disc to form the rotor fusion plate. These annular dams 299 allow a distinct separation between the rows 220 of fusion bars 240 and serve to force the material to travel out of the grooves 230 and into the gap formed between the rotor and stator discs at a substantially fixed radial location. Forcing the material out of the grooves 230 and into the gap causes the material to form the desired thick fiber pad to accumulate in the gap between the discs. It is the ability to form the thick fiber pad using flat top bars and narrow gap between discs which differentiates the embodiments of this disclosure from conventional disperser or refiner plates. In some embodiments, the annular dams may be somewhat below the surface of the plates in some or all of their radial locations.

FIG. 2 shows the processing zone 280 extending in a series of rows 220 from the end of the feeder zone 210 to the outer portion or outer periphery 260 of the rotor fusion plate segment 200. As discussed above, the rows 220 of fusion bars 240 may not extend to the outer periphery 260 of the rotor fusion plate segment 200, and other rows of bars or flat surface (not shown) may be radially outward of the processing zone 280.

Figure 3:
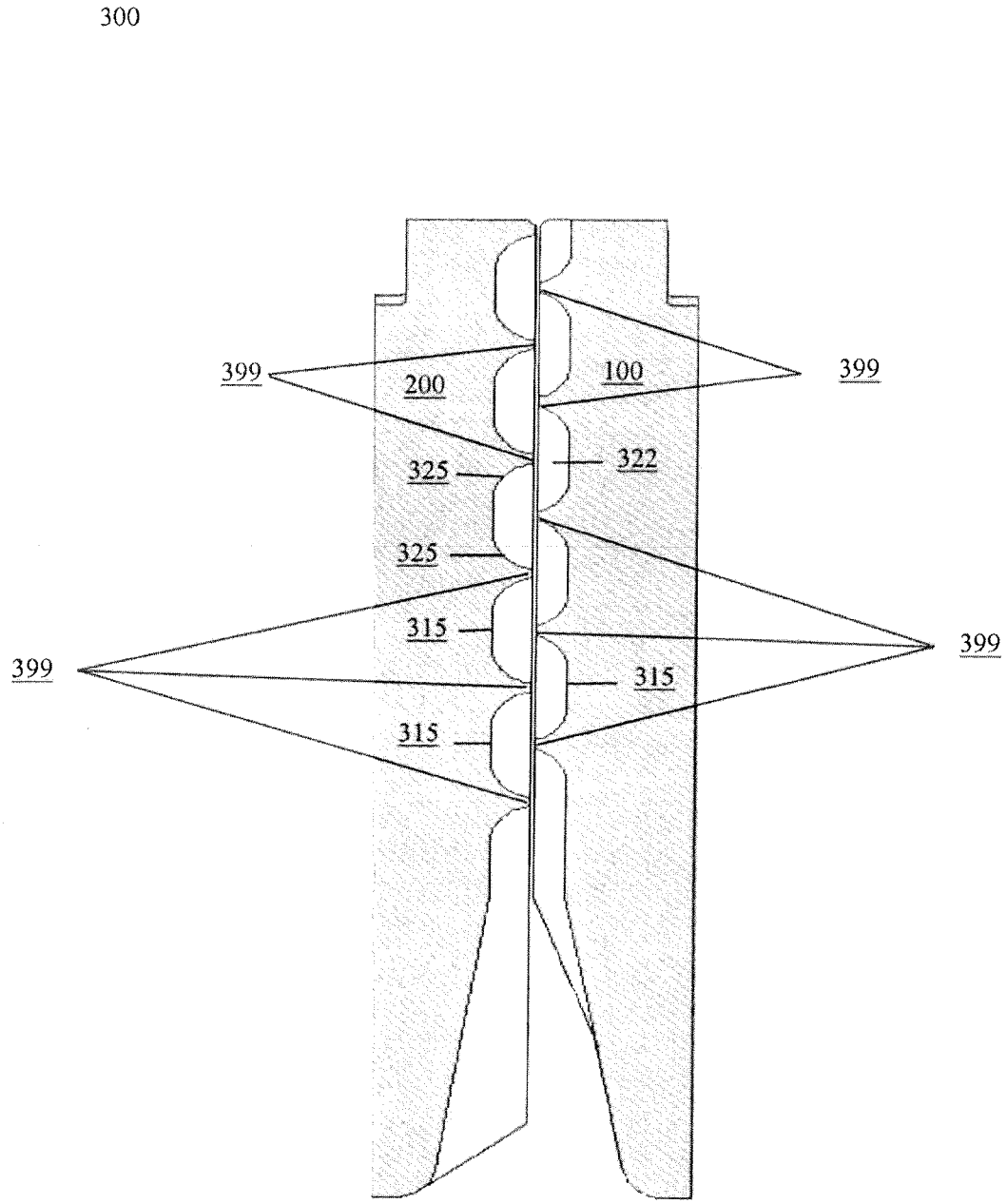
FIG. 3 shows the cross-sectional view of opposing stator and rotor discs showing a bowl-shaped groove pattern.

FIG. 3 shows the cross-sectional view of the stator fusion plate segment 100 and rotor fusion plate segment 200 assembled in a disperser 300 and having opposing front surfaces separated by a narrow gap, such as less than 1 mm or 2 mm to 3 mm or less than 6 mm. The bowl-shaped grooves 322 (grooves having a bowl cross-sectional shape) between the rows of fusion bars are defined by the sloped surfaces of the grooves at either end of each row of fusion bars. The bowl-shaped grooves 322 have the sloping sides 325 in successive rows and the annular flat surface 315 separating the successive rows. Shown between the bars formed by sloping sides 325 are the annular dams 399. These annular dams 399 allow a distinct separation between the rows of fusion bars and serve to force the material to travel out of the bowl-shaped grooves 322 and into the gap formed between the rotor and stator discs at a substantially fixed radial location. Forcing the material out of the bowl-shaped grooves 322 and into the gap, causes the material to form the desired thick fiber pad to accumulate in the gap between the discs The width of a bowl-shaped groove 322 extends between the tops of adjacent annular dams 399. The opposing stator fusion plate segment 100 and rotor fusion plate segment 200 have grooves shapes (bowl-shaped grooves 322) which when engaged form a serpentine type pattern resembling a series of bowls opposing bowls and extending radially.

As shown in FIG. 3, when the stator and rotor fusion plate segments 100, 200 are mounted on a disc substrate and oppose each other, the grooves of the opposing stator and rotor fusion plate segments 100, 200 overlap such that along the surface of the stator and rotor fusion plate segments 100, 200 an open area formed by the groove extends the length (radially) of the processing zone and the circumference of the circular assembly of stator and rotor fusion plate segments 100, 200. For the processing zone, where fusion plate segments are used, each bowl-shaped groove 322 section on a stator fusion plate segment 100 overlaps two bowl-shaped grooves 322 of the opposing rotor fusion plate segment 200, and conversely, each bowl-shaped groove 322 section on a rotor fusion plate segment 200 overlaps two bowl-shaped grooves 322 of the opposing stator fusion plate segment 100. Said another way, where a groove ends on one fusion plate segment (stator or rotor) falls substantially near the middle of the groove of the opposite (stator or rotor) fusion plate segment. The configuration of annular dams 399 and bowl-shaped grooves 322 of opposing plates results in a forced serpentine flow of the pulp going back and forth between the opposing discs, which is a path somewhat similar to the pulp flow path through a conventional disperser's intermeshing teeth or pyramids. In some embodiments, some or all of the annular dams may be at a height somewhat below the surface plane of the fusion bars.

Figure 4:
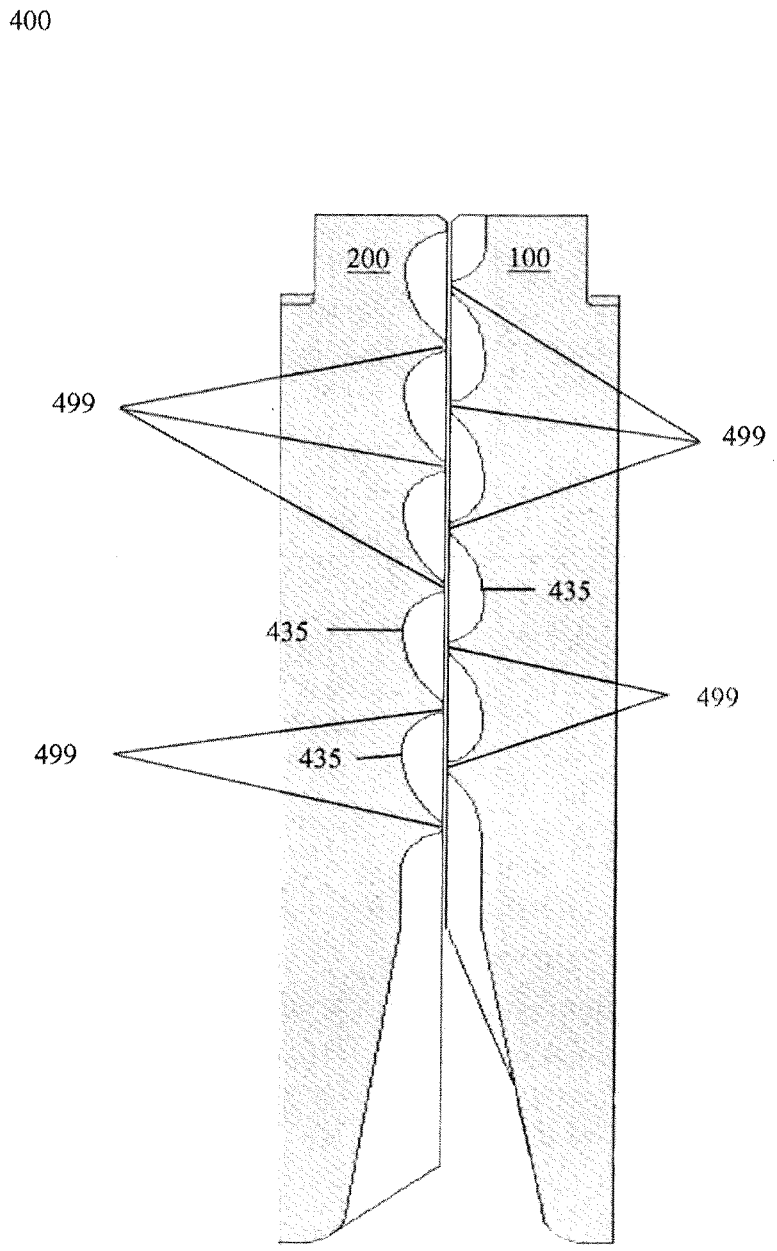
FIG. 4 shows the cross-sectional view of opposing stator and rotor discs showing a sinusoidal-shaped groove pattern.

FIG. 4 shows the cross-sectional view of a disperser 400 where the stator fusion plate segment 100 and rotor fusion plate segment 200 have sinusoidal-shaped grooves 435 when the fusion plate segments (stator and rotor) 100, 200 are opposing each other having opposing front surfaces separated by a narrow gap, such as less than 1 mm or 2 to 3 mm or less than 6 mm. The reference numerals 100, 200 designate the stator fusion plate segment and rotor fusion plate segments respectively. The sinusoidal-shaped grooves 435 between the rows of fusion bars are defined by the sloped surfaces of the grooves at either end of each row of fusion bars. In this embodiment, the sinusoidal-shaped grooves 435 of the opposing fusion plate segments (stator and rotor) 100, 200 form a serpentine type pattern extending in a radial direction. In FIG. 4, the grooves extend substantially continuously such that the sloping sinusoidal-shaped grooves 435 have sloping lines. When the stator fusion and rotor fusion plate segments 100, 200 are placed in position, the grooves overlap so along the surface of the fusion plate segments a pattern open area, groove, extends the entire length of the processing zone. For the processing zone, where fusion plate segments are used, each sinusoidal-shaped groove 435 section on a stator fusion plate segment 100 overlaps two sinusoidal-shaped grooves 435 of the opposing rotor fusion plate segment 200, and conversely, each sinusoidal-shaped groove 435 section on a rotor fusion plate segment 200 overlaps two sinusoidal-shaped grooves 435 of the opposing stator fusion plate segment 100. Said another way, where a groove ends on one fusion plate segment (stator or rotor) falls substantially near the middle of the groove of the opposite (stator or rotor) fusion plate segment. The configuration of annular dams 499 and sinusoidal-shaped grooves 435 of opposing plates results in a forced serpentine flow of the pulp going back and forth between opposing discs, which is a path somewhat similar to the pulp flow path through conventional disperser's intermeshing teeth or pyramids.

As shown in FIG. 3, in the embodiment of FIG. 4 the annular dams 499 are shown, between the bars formed by sinusoidal-shaped grooves 435. These annular dams 499 allow a distinct separation between the rows of fusion bars and serve to force the material to travel out of the sinusoidal-shaped grooves 435 and into the gap formed between the rotor and stator discs at a substantially fixed radial location. Forcing the material out of the sinusoidal-shaped grooves 435 and into the gap causes the material to form the desired thick fiber pad to accumulate in the gap between the discs. In some embodiments, some or all of the annular dams may be at a height somewhat below the surface plane of the fusion bars.

Figure 5:
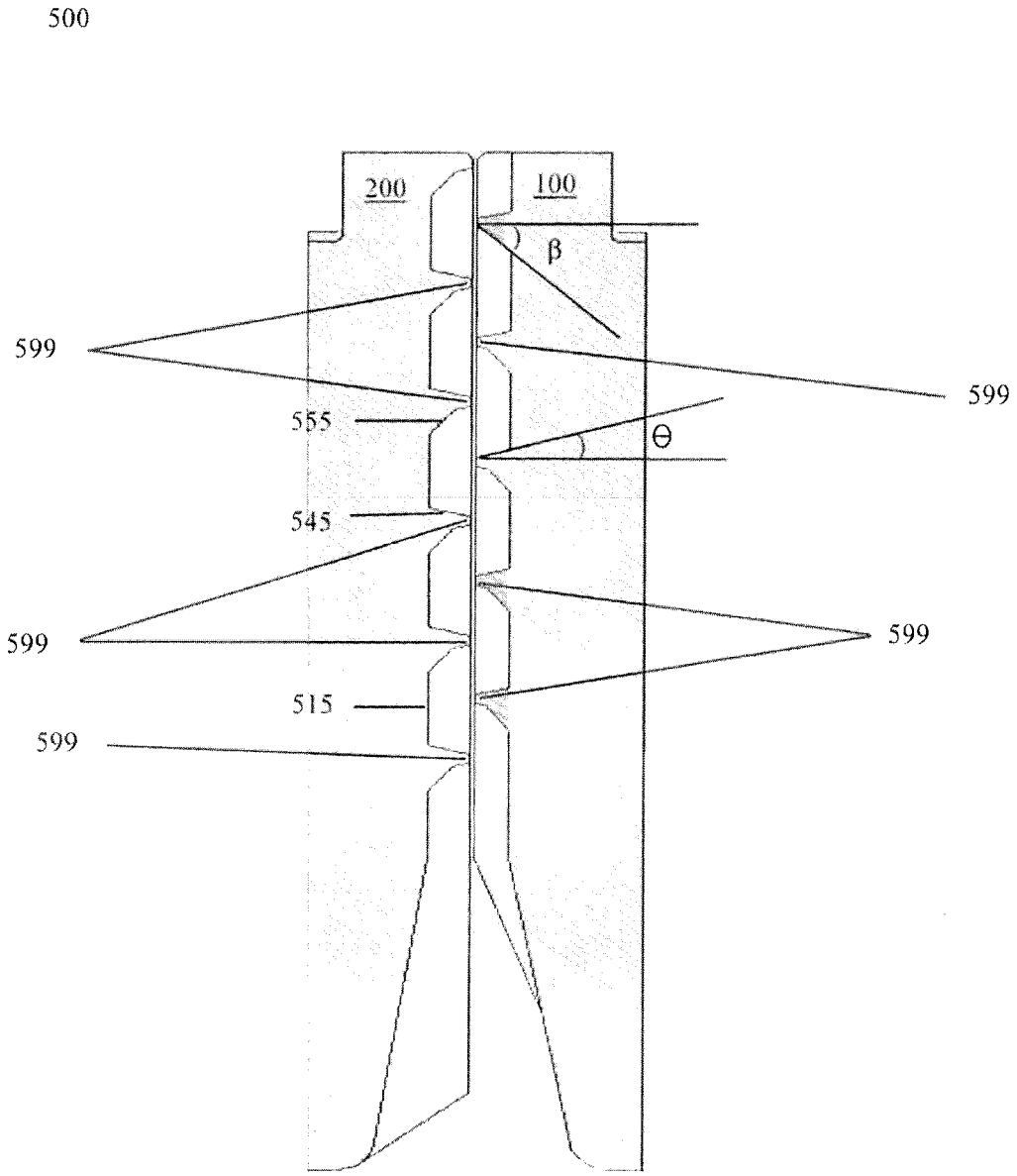
FIG. 5 shows the cross-sectional view of opposing stator and rotor discs showing a modified box-shaped groove pattern.

FIG. 5 shows the cross-sectional view of the disperser 500 where the stator fusion plate segment 100 and rotor fusion plate segment 200 assembled in a disperser 500 and having opposing front surfaces that define a gap, such as less than 1 mm or 2 mm to 3 mm or less than 6 mm and having a modified box-shaped groove when in their engaged position. In one exemplary embodiment, gaps of 1 mm to 2 mm may be desirable when high compressive force is desired to increase partial refining of recovered paper or packaging material while balancing the dispersing effect. Gaps of 3 mm to 6 mm for example may be desirable when more dispersion and less refining is desired. Gaps of less than 1 mm may be desirable for example when more refining than dispersing is desired.

This embodiment of the disclosure engages stator fusion plate segments 100 and rotor fusion plate segments 200, having a modified box-shaped grooves between the rows of fusion bars such that the modified box-shaped grooves are defined by the sloped surfaces of the grooves at either end of each row of fusion bars, and which when engaged form a modified box serpentine type pattern when the fusion plate segments (stator and rotor) face each other. The first side of the modified box groove 545 shape may be straight and almost perpendicular (between 70 and 100 degrees, an angle of θ) to the surface of the fusion plate segments (stator or rotor), while the second side of the modified box groove 555 shape may be a line in one or multiple parts form an angle β of between 20 and 70 degrees, with a flat straight bottom section 515 of the modified box groove shape. When the fusion plate segments (stator or rotor) are placed in position, the grooves overlap so along the surface of the fusion plate segments a patterned open area, groove, extends the entire length of the processing zone. For the processing zone, where fusion plate segments are used, each modified box-shaped groove section on a stator fusion plate segment 100 overlaps two modified box-shaped grooves of the opposing rotor fusion plate segment 200, and conversely, each modified box-shaped groove section on a rotor fusion rotor plate segment 200 overlaps two modified box-shaped grooves of the opposing stator fusion plate segment 100. Said another way, where a groove ends on one fusion plate segment (stator or rotor) falls substantially near the middle of the groove of the opposite (stator or rotor) fusion plate segment.

Additionally, as shown in FIGS. 3 and 4, annular dams 599 are shown between the fusion bars on each of the stator fusion plate segments 100 and rotor fusion plate segments 200. The configuration of the annular dams 599 and the modified box-shaped grooves (which may be formed by the first side of the modified box groove 545, second side of the modified box groove 555 and flat straight bottom section 515) of the opposing plates results in a forced serpentine flow of the pulp going back and forth between the opposing discs, which is a path somewhat similar to the pulp flow path through a conventional disperser's intermeshing teeth or pyramids. These annular dams 599 allow a distinct separation between the rows of fusion bars and serve to force the material to travel out of the modified box-shaped grooves and into the gap formed between the rotor and stator discs at a substantially fixed radial location. Forcing the material out of the modified box-shaped grooves and into the gap between the stator and rotor discs, causes the material to form the desired thick fiber pad to accumulate in the gap between the discs. In some embodiments, some or all of the annular dams may be at a height somewhat below the surface plane of the fusion bars.

Figure 6:
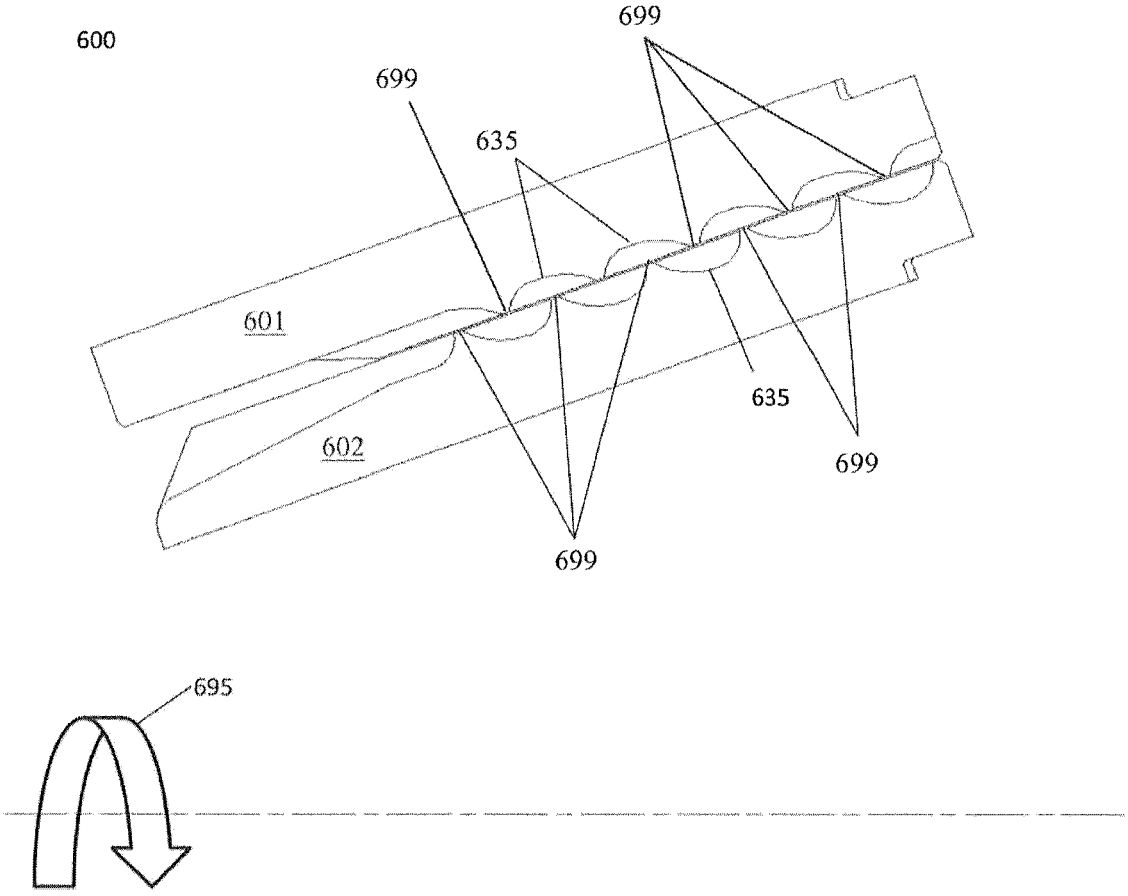
FIG. 6 shows the cross-sectional view of opposing cones used in a conical refiner showing a sinusoidal groove pattern.

FIG. 6 shows the cross-sectional view of a conical disperser 600 with stator fusion plate 601 and rotor fusion plate 602 mounted on stator and rotor cones respectively with sinusoidal-shaped grooves 635. The stator fusion plate 601 and rotor fusion plate 602 are shown in their engaged position within a conical type machine. This embodiment of the disclosure engages stator fusion plate 601 and rotor fusion plate 602 having groove shapes which when the stator fusion plate 601 and rotor fusion plate 602 are engaged and face each other form a sinusoidal serpentine type pattern. The smooth sinusoidal-shaped grooves 635 between the rows of fusion bars are defined by sloped surfaces of the grooves at either end of each row of fusion bars. In this embodiment, the sinusoidal-shaped grooves 635 of the opposing stator fusion plate segment 601 and rotor fusion plate segment 602 form a serpentine type pattern extending in a radial direction. The annular dams 699 and sinusoidal-shaped grooves 635 of opposing plates results in a forced serpentine flow of pulp going back and forth between the opposing discs, which is a path somewhat similar to the pulp flow path through conventional disperser's intermeshing teeth or pyramids.

These annular dams 699 serve the same function as described previously in FIGS. 1, 2, 3, 4, and 5. The annular dams 699 allow a distinct separation between the rows of fusion bars and serve to force the material to travel out of the sinusoidal-shaped grooves 635 and into the gap formed between the rotor and stator cones at a substantially fixed radial location. Forcing the material out of the sinusoidal-shaped grooves 635 and into the gap, may cause the material to form the desired thick fiber pad to accumulate in the gap between the cones. In some embodiments, some or all of the annular dams may be at a height somewhat below the surface plane of the fusion bars.

When the stator and rotor fusion plates mounted on the cones of a conical type machine are placed in position, the grooves overlap along the surface of the cones (stator and rotor) a pattern open area, groove, extends the entire length of the processing zone. For the processing zone, where cones (stator and rotor) are used, each sinusoidal-shaped groove section on a fusion plate mounted on the stator cone overlaps two sinusoidal-shaped grooves of the opposing fusion plate mounted on the rotor cone, and conversely, each sinusoidal-shaped groove section on a fusion plate mounted on a rotor cone can overlap two sinusoidal-shaped grooves of the opposing fusion plate mounted on the stator cone. Said another way, where a groove ends on one fusion plate mounted on the cone (stator or rotor) it fall substantially near the middle of the groove of the fusion plate mounted on the opposite (stator or rotor) cone. In a conical machine, the cones are set at an angle to the horizontal with a centerline of rotation 695.

While preferred embodiments have been shown and described, various modifications and substitutions may be made thereto without departing from the spirit and scope of the invention. Accordingly, it is to be understood that the present invention has been described by way of illustration and not limitation.

What is claimed is:

1. A disperser assembly comprising:

opposing arrays of fusion plate segments defining a planar gap between the opposing arrays of fusion plate segments, wherein each fusion plate segment comprises a front surface having rows of alternating fusion bars and grooves, wherein each fusion bar has a planar upper surface and each row of alternating fusion bars and grooves is separated by annular dams located at substantially fixed radial locations on the front surface of each opposing fusion plate segment, wherein each groove is disposed substantially co-linear with a radial line extending from a center of rotor rotation to an outer periphery of the front surface, wherein a number of alternating fusion bars and grooves increases as the rows of alternating fusion bars and grooves extends radially outward from an inner periphery of the front surface to the outer periphery, wherein grooves in a row closer to the outer periphery have a width less than the width of grooves in a row closer to the inner periphery, wherein the opposing arrays of fusion plate segments are arranged such that the annular dams on one fusion plate segment align with a row of fusion bars and grooves on an opposing fusion plate segment, and wherein the grooves form a serpentine passage extending radially between the opposing arrays of fusion plate segments.

2. The disperser assembly of claim 1, wherein the arrays of fusion plate segments are mounted on disperser discs.

3. The disperser assembly of claim 1, wherein the arrays of fusion plate segments are mounted on disperser cones.

4. The disperser assembly of claim 1, wherein the annular dams have substantially the same height as the planar upper surface of each fusion bar.

5. The disperser assembly of claim 1, wherein at least one of the annular dams have a height lower than the planar upper surface of each fusion bar.

6. The disperser assembly as in claim 1, wherein a width of one of the grooves is narrower between rows of fusion bars that are radially outward on the fusion plate segments than for one of the grooves between rows of fusion bars that are radially inward on the fusion plate segments.

7. The disperser assembly as in claim 1, wherein the front surface of the fusion plate segments is divided into at least one of a feed zone, a processing zone, a flat surface between an inner periphery, and an outer periphery of the fusion plate segments.

8. The disperser assembly of claim 7, wherein the processing zone of the front surface of the fusion plate segments is comprised of rows of bars extending between the feed zone on the fusion plate segments and the periphery of the fusion plate segments.

9. The disperser assembly of claim 8, wherein the annular dams between rows of fusion bars and grooves on one fusion plate segment are substantially aligned with a nadir of the grooves of the rows of fusion bars and grooves on the opposing fusion plate segment.

10. The disperser assembly of claim 9, wherein the fusion bars are separated from each other by grooves substantially as wide as a width of a single fusion bar.

11. The disperser assembly of claim 10, wherein the grooves between the fusion bars in a radially outward row are narrower than the grooves between the fusion bars a radially inward row.

12. The disperser assembly of claim 7, wherein the rows of fusion bars with planar upper surfaces in the processing zone extend at least one-half the radial distance from a feeding zone on the front surface of the fusion plate segments to an outer periphery of the fusion plate segments.

13. The disperser assembly of claim 1, wherein a radius of an end of one of the grooves on the front surface of one of the fusion plate segments substantially aligns with the radius of a center of a groove on the opposing fusion plate segment.

14. The disperser assembly of claim 1, wherein the planar gap is no greater than one millimeter.

15. The disperser assembly of claim 1, wherein the grooves form a sinusoidal passage extending radially between the opposing arrays of fusion plate segments.

16. The disperser assembly of claim 1, wherein the grooves form a modified box groove passage extending radially between the opposing arrays of fusion plate segments, the modified box groove passage having a first side and a second side.

17. The disperser assembly of claim 1, wherein the grooves of one fusion plate segment are shallower than the grooves of the opposing fusion plate.

18. The disperser assembly of claim 1, wherein grooves of one fusion plate segment are narrower than grooves of the opposing fusion plate.

19. The disperser assembly of claim 1, wherein a shape of the grooves within the rows of fusion bars and grooves change among the rows of fusion bars and grooves.

20. A disperser assembly comprising:

opposing fusion plates, wherein each fusion plate comprises a front surface, the front surface having rows of alternating fusion bars and grooves, wherein each fusion bar has a planar upper surface and each row of alternating fusion bars and grooves is separated by annular dams located at substantially fixed radial locations on the front surface of each opposing fusion plate, wherein a number of alternating fusion bars and grooves increases as the rows of alternating fusion bars and grooves extends radially outward along from an inner periphery of the front surface to an outer periphery of the front surface, wherein grooves in a row closer to the outer periphery have a width less than the width of grooves in a row closer to the inner periphery, wherein the opposing fusion plates are arranged such that the annular dams on one fusion plate substantially align with a row of fusion bars and grooves on an opposing fusion plate, and wherein the grooves define a serpentine passage extending radially between the opposing fusion plates.

* * * * *